United States Patent [19]

Purcell

[11] Patent Number: 4,492,166

[45] Date of Patent: Jan. 8, 1985

[54] SUBMUNITION HAVING TERMINAL TRAJECTORY CORRECTION

[75] Inventor: William O. Purcell, Maitland, Fla.

[73] Assignee: Martin Marietta Corporation, Bethesda, Md.

[21] Appl. No.: 791,805

[22] Filed: Apr. 28, 1977

[51] Int. Cl.[3] ..... F42B 25/16; F42B 25/24

[52] U.S. Cl. ..... 102/384; 102/393; 244/3.22; 244/3.28

[58] Field of Search ..... 102/3, 384, 393; 244/3.27, 3.28, 3.2, 3.3, 3.16, 3.22; 89/1.5 E

[56] References Cited

U.S. PATENT DOCUMENTS

| | | | |
|---|---|---|---|
| 2,424,193 | 7/1947 | Rost et al. | 102/3 |
| 3,010,677 | 11/1961 | Guthrie et al. | 102/3 |
| 3,128,061 | 4/1964 | Chew | 102/3 |
| 3,185,097 | 5/1965 | Kushing et al. | 244/3.28 |
| 3,622,103 | 11/1971 | Meier | 244/3.28 |
| 3,964,391 | 6/1976 | Jacharin | 244/3.27 |

*Primary Examiner*—Charles T. Jordan

*Attorney, Agent, or Firm*—William J. Iseman; Patrick M. Hogan; Gay Chin

[57] ABSTRACT

A submunition having an infrared detector disposed in a nose portion thereof, the detector having a narrow angularly-displaced field of view, and vanes for causing the submunition to rotate at an essentially constant rate while in flight, thus to cause the infrared detector to scan a target area and to detect the presence of a target having a selected higher temperature than the background infrared radiation. The submunition includes a small explosive charge sheet disposed on its outer surface and concentrated in one area, and firing pulse generation means for firing the charge. When the infrared detector scans past a detectable target within the target area, it produces a detection signal that triggers a firing pulse from the firing pulse generation means, thereby firing the explosive charge to create a lateral impulse or offset of the submunition. Timing means is provided to cause the impulse to be produced in the exact direction to correct the terminal trajectory of the submunition to intercept the detected target, so that the warhead carried by the submunition can cripple or destroy the target. This novel correctable-trajectory submunition is therefore seen to be a low-cost device having high kill probability when air-dropped in clusters, thereby providing very high cost effectiveness.

8 Claims, 11 Drawing Figures

SUBMUNITION HAVING TERMINAL TRAJECTORY CORRECTION

BACKGROUND OF THE INVENTION

1. Field of the Invention

The invention generally pertains to ordinance devices and submunitions of the bomblet type that may be air-dropped in clusters, and more specifically to a submunition having a terminal correction guidance system.

2. Description of the Prior Art

Attacks against enemy tanks, vehicles, convoys and other targets may be carried out by artillery, mortars, aerial bombs, and missiles. It is common to use a carrier missile or vehicle to deliver and dispense a large number of bomblet-type warheads over the target area. Such warheads may be very cheap, costing several dollars each; however, the individual kill probability is extremely low and the cost effectiveness is therefore poor. On the other hand, a very sophisticated missile-type warhead may be used having radar, optical, or infrared guidance systems. While the individual kill probability is very high for such warheads the cost will be in the thousands of dollars each and the cost effectiveness is also poor. There is no low-cost warhead known in the prior art having a high kill probability.

SUMMARY OF THE INVENTION

The invention is a submissile of the bomblet type having a simple, low cost infrared (IR) detection system for detecting the presence of a "hot" target, and a terminal trajectory correction system for correcting the trajectory of the submissile to cause it to intercept the target. When dropped in a cluster-type configuration, a high kill probability is achieved for the cluster.

Typical military targets such as tanks or other vehicles with engines running, artillery, guns when firing, and auxiliary power sources provide a unique infrared (IR) signature that can be identified against an earth background. This IR signature is accordingly used as a source of information for the terminal correction action of the invention.

A typical submunition in accordance with the invention may be in the form of a small mortar-sized bomblet having a shaped-charge warhead and a set of rearwardly extending vanes. An infrared detection assembly having a boresight slightly offset from the bomblet axis is mounted rigidly in the nose section of the bomblet. The submunition may be dropped vertically from a missile or other vehicle from an altitude that will allow it to reach terminal velocity before approximately 1000 feet of altitude. The bomblet vanes have a cant angle to cause the unit to spin at 10 to 15 revolutions per second as it drops. The sensor field-of-view (FOV) at 1000 feet may be in the order of a 16 square foot area on the ground, and the boresight from this altitude is displaced about 200 feet on the ground from the unguided impact point. As the submunition spins and drops, the FOV traces an inward spiral on the ground. When the sensor FOV passes a hot target, the sensor signal suddenly increases. Electronic circuits sense the point at which the signal exceeds a preset threshold and initiate an explosive impulse control by firing a small section of explosive material disposed on the outside surface of the bomblet at the instant that the explosive material is directly opposite the bearing of the detected target. The impulse thus generated causes a deviation of the bomblet trajectory in the direction of the target.

The velocity vector deviation is a fixed selected value based on the bomblet velocity and FOV offset angle. By matching these factors, the submissile can be made to impact within approximately 3 feet of the hot target. The simplicity of the detection and correction technique results in a submunition that can be implemented at relatively low cost.

It is therefore a primary object of the invention to provide a submunition having a terminal trajectory correction system that will result in a high kill probability.

It is another object of the invention to provide a terminal trajectory correction submunition having an infrared target detection system.

It is yet another object of the invention to provide a terminal trajectory correction submunition that can be produced at relatively low cost.

It is still another object of the invention to provide a submunition having an impulse-type correction device for deviating the submunition trajectory toward a target.

It is a further object of the invention to provide a submunition having an IR detector with an offset field-of-view and which, when dropped, caused by means of a set of canted vanes to rotate.

These and other objects and advantages of the invention may be understood from the detailed description hereinafter and with reference to the drawings.

DETAILED DESCRIPTION OF THE PREFERRED EMBODIMENT

The present invention is a low-cost, accurate, terminally-corrected submissile that utilizes the infrared radiation signature of a ground target. The external configuration of the submissile, or bomblet, is shown in FIG. 1 and 2, and the internal construction is indicated in FIG. 3.

Figure 1:
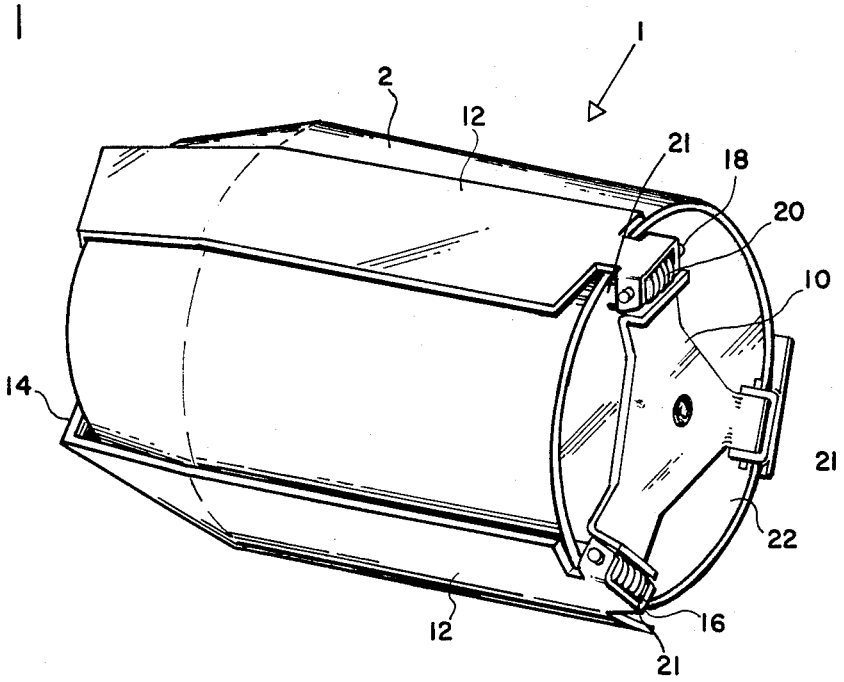
FIG. 1 is a perspective view of the submunition in its closed condition for storage and transporting.

Turning to FIG. 1, the bomblet 1 is shown in the closed position such as for storage and transport. Visible in FIG. 1 is a metallic shell 2 with a rear end plate 22. End plate 22 has three equally-spaced hinge tabs 21 around its periphery to which a set of vanes 12 is attached by means of vane hinges 16, hinge pins 18, and hinge springs 20. Springs 20 are arranged to load the vanes when in the folded position and the vanes are held in the folded position by vane release plate 10. Each vane 12 has at its outer end a clip 14 that hooks over the front end of shell 2 in the closed position thereby holding front release plate 5, (best seen in FIG. 3 and FIG. 4) in place, covering the front end of shell 2.

Figure 2:
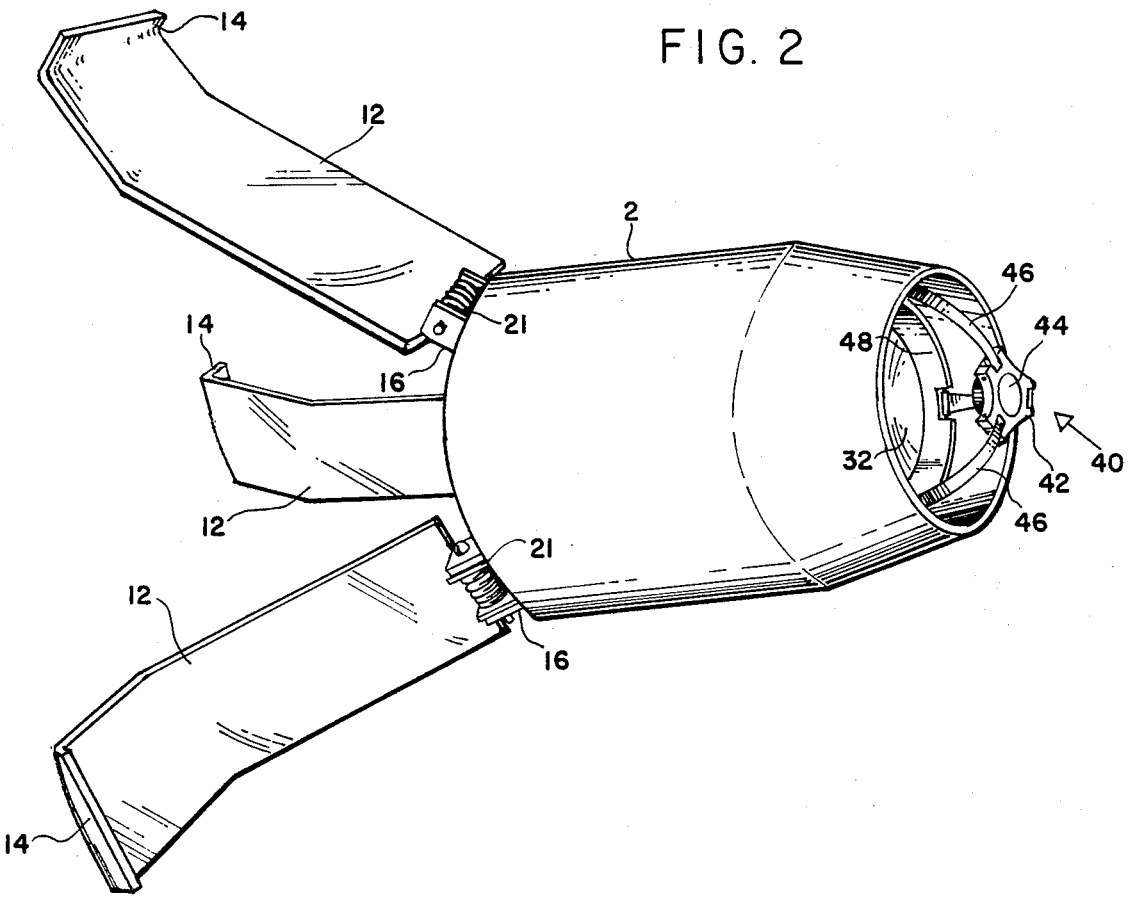
FIG. 2 is a perspective view of the submunition in the open or extended condition that is assumed when the device is dropped.
Figure 3:
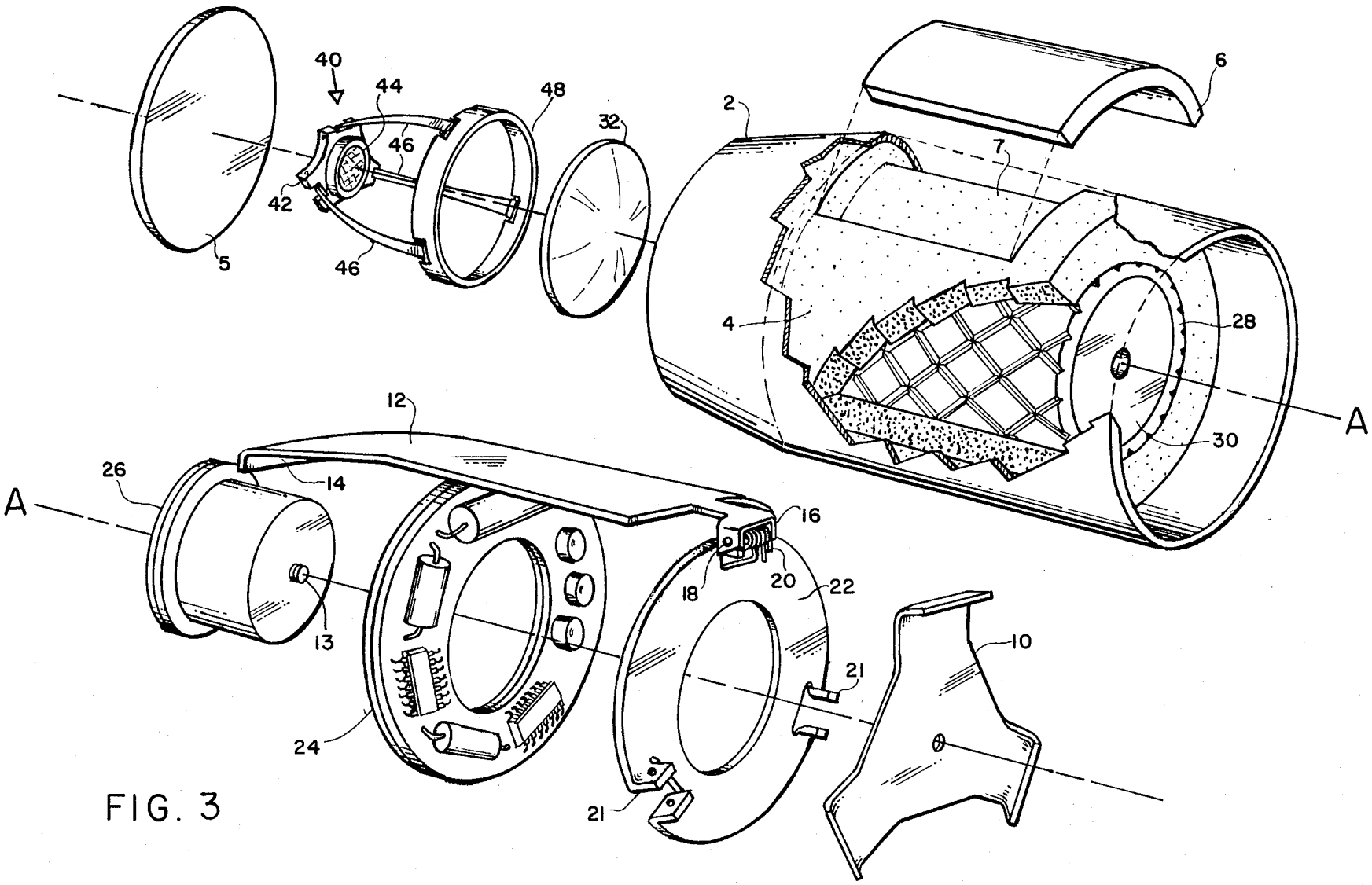
FIG. 3 is an exploded view of the submunition showing the components thereof, with certain sections cut away.
Figure 4:
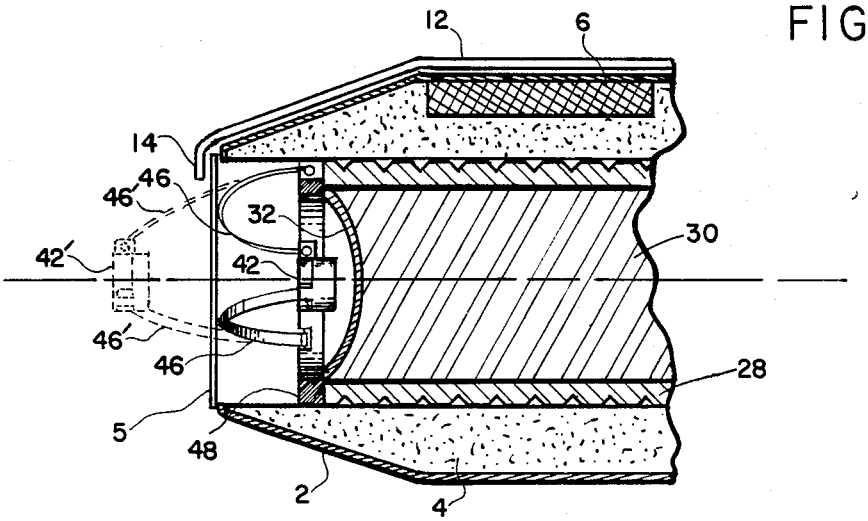
FIG. 4 is a cross sectional view of the nose section of the submunition illustrating the IR detector assembly in the folded configuration.

FIG. 2 illustrates the bomblet in the open or active configuration. Normally a cluster of bomblets will be dropped at an altitude greater than 1000 feet. As bomblet 1 is dropped, vane release plate 10 is ejected, allowing springs 20 to cause vanes 12 to extend to the open position as shown in FIG. 2. As may be understood, the opening of vanes 12 releases front release plate 5, exposing heat detector assembly 40. Detector assembly 40 consists of detector mounting ring 48 recessed in the front or nose end of bomblet 1, a set of three leaf springs 46 having inner ends pinned to mounting ring 48 and outer ends pinned to detector holder 42, and IR detector 44 inserted in holder 42. In the closed configuration of FIG. 1, detector holder 42 is folded into the recessed nose portion of bomblet 1, placing leaf springs 46 under tension. The assembly is held in this folded condition by release plate 5 and clip ends 14 of vanes 12 as best seen in FIG. 4. Thus, when release plate 5 is released and jettisoned, holder 42 springs outward into the operative position as shown in FIG. 2.

As bomblet 1 drops, vanes 12, due to a canted attitude, provide rotation means to cause the bomblet to spin. A typical spin rate may be 10 to 15 revolutions per second. The submunition is normally dropped from an altitude that will permit terminal velocity to be reached before 1000 feet of altitude.

FIG. 3 is an exploded view of bomblet vehicle 1 with portions thereof partially cutaway to show the various internal portions of the invention. Metallic shell 2 may be seen to house the payload, a centrally disposed cylindrical explosive warhead 30 which is housed in fragmentation case 28 having its outer peripheral surface scored. The space between fragmentation case 28 and shell 2 is filled with polyurethane foam forming attenuator 4. Attenuator 4 has a recess 7 for receiving a section of "sheet" explosive material 6, such a DuPont "Detasheet". The Detasheet material is a small explosive charge that when fired serves as an impulse generation means to provide a lateral impulse to the bomblet, as will be explained in detail hereinafter.

The forward end of cylindrical explosive warhead 30 is capped by a parabolic Misznay-Schardin (MS) disc 32 (as best seen in the cross section view of FIG. 4) for optimum effectiveness as compared to a linear shaped charge. The warhead thus formed from explosive 30, case 28, and MS disk 32 is capable of penetrating armor plate. Advantageously, the forward or concave side of MS disk 32 is given a mirror surface, which forms a part of the IR target detection system of the invention. The heat detection assembly 40 is shown in FIG. 3 in its operative configuration in which IR detector 44 is extended and at the focal point of the mirror surface of MS disk 32.

The rear section of shell 2 can be seen to contain fuze 26 which is arrange to detonate explosive charge 30 on impact of bomblet 1. Ring-shaped electronic assembly 24 fits over the body portion of fuze 26 and mounts the integrated circuits, and discrete electronic components required by the invention as will be explained below. Rear end plate 22 fits snugly into the rear end of shell 2 and over the rear portion of fuze 26. Shell 2 may be crimped or spot welded to rear plate 22 to form an integral assembly. Plate 22 includes three sets of hinge tabs 21 for mounting the three vanes 12. One such vane 12 is shown for exemplary purposes in its closed position, although it is to be understood that spring 20 tends to open vanes 12 when vane release plate 10 is not in place. Release plate 10 is centered by stud 13 on fuze 26 and hole 11 so as to block vane hinges 18, thereby maintaining vanes 12 in the closed position. As previously mentioned, release plate 10 drops off when the bomblet is released allowing vanes 12 to snap to their open position, with vane hinge 18 shaped to act as a stop against rear plate 22 thereby maintaining the vanes 12 in the desired orientation.

Figure 5:
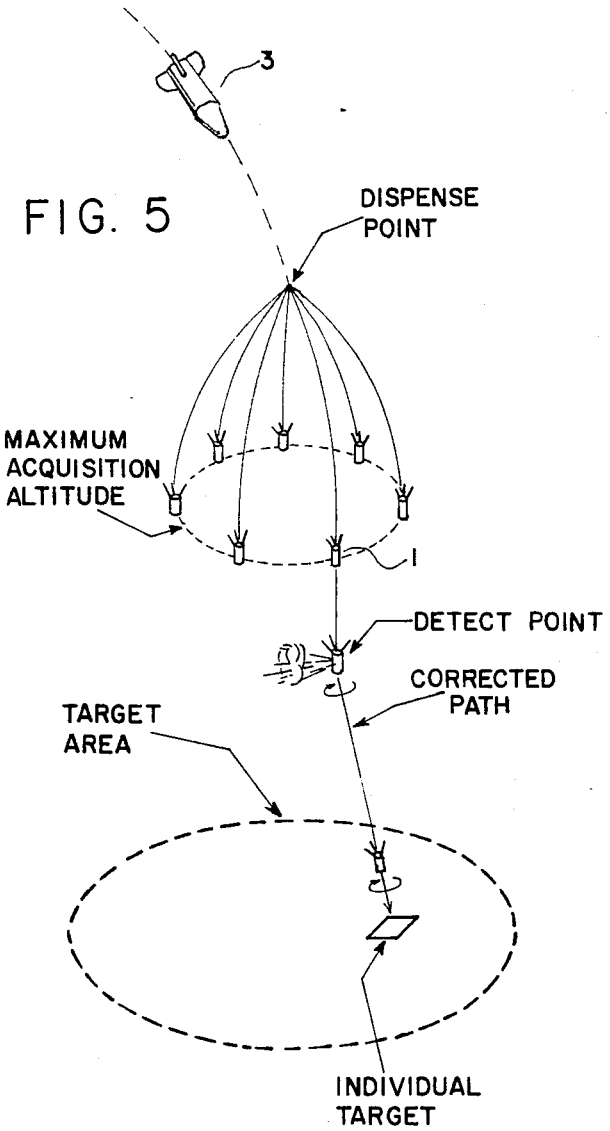
FIG. 5 is a schematic diagram showing the dropping of a cluster of submunitions and the corrective action of one of such submunitions.

Having described the basic elements and construction of the terminally-guided bomblet, the functional operation will be explained. In FIG. 5, a schematic representation of a typical deployment of bomblets is shown, with the scale exaggerated for exemplary purposes. Missile 3 carries a cluster of bomblets, releasing the cluster at the dispense point. Each bomblet opens, with the extended vanes causing the bomblets to spin. The dispense point is selected to allow the bomblets to achieve terminal velocity at the maximum acquisition altitude, which may be 1000 feet. For example, bomblet 1, shown at the maximum acquisition altitude, will be dropping at a constant velocity. The detector assembly 40 in the nose end of bomblet 1 has a field of view (FOV) determined by mirror plate 32 and IR detector 44 which of course is slightly offset from the bomblet axis. Thus, the spinning action of bomblet 1 causes the FOV to describe the arcuate path on the ground with a radius determined by the degree of offset and the altitude of the bomblet. A typical maximum radius of the target area may be 200 feet. As may be recognized, the radius of the FOV path decreases continuously as the bomblet falls, causing the FOV to trace an inward spiral path. Assume an individual target such as an operative tank, is within the target area. As the FOV passes over the target, the heat from the engine compartment is detected by IR detector 44. Electronic circuits mounted on electronics assembly 24 generate a triggering pulse, causing sheet explosive 6 to fire. Firing of the sheet explosive 6 generates a lateral impulse on the bomblet 1. Attenuator 4 serves to more evenly distribute the impulse energy, and prevents premature detonation of the warhead charge 30. The impulse changes the flight path of the dropping bomblet as shown such that the bomblet 1 will intercept the target.

Upon impact, fuze 26 detonates warhead charge 30, with fragmentation case 28 providing destructive material in addition to the primary kill mechanism, i.e. the MS plate.

Figure 6:
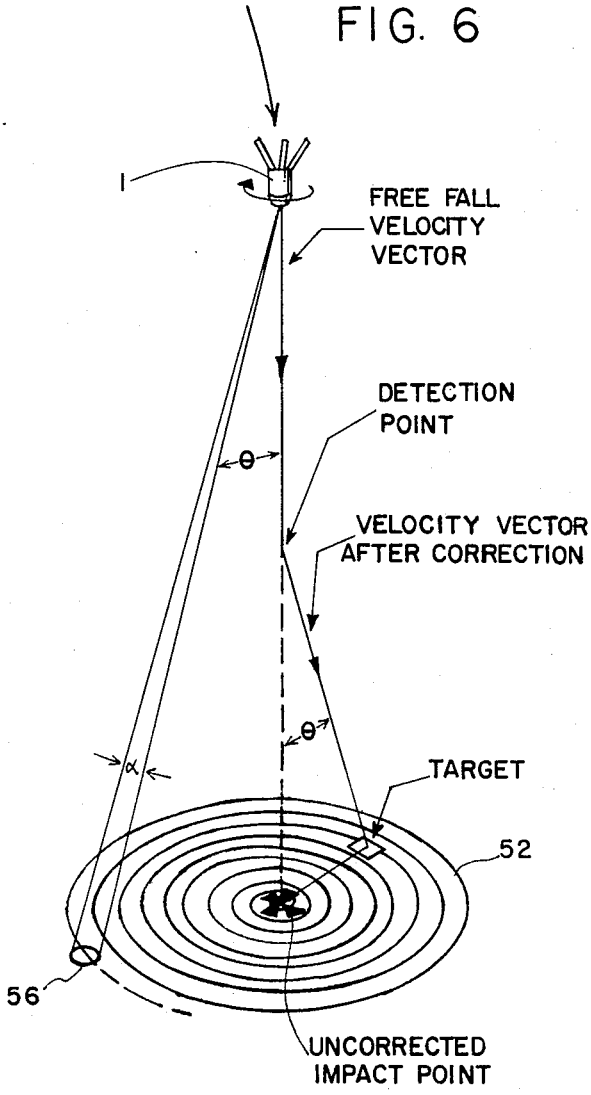
FIG. 6 is a schematic diagram showing the geometry of the spiral scan, target detection, and trajectory correction action of a submunition in accordance with, the invention.

A typical geometry is illustrated in FIG. 6 with bomblet 1 in its free fall state. The FOV angle $\alpha$ may be selected for a desired FOV size to match a particular type target. For example, an angle $\alpha$ of 7 milliradians will provide an FOV of about 16 square feet from a 1000 foot altitude, matching the hot spot of a typical tank or vehicle engine.

The offset $\theta$ of the FOV from the free fall velocity vector may be selected in accordance with the FOV angle, and the fall velocity to ensure complete scanning of the target area. For an $\alpha$ of 7 milliradians, an offset angle $\theta$ of 11.3° has been found to be suitable.

At the detection point, the velocity vector is corrected by the impulse from firing of the Detasheet material. Advantageously, the size of the Detasheet is selected to suit the weight and terminal velocity of the bomblet to cause a correction equal to the offset angle $\theta$. By reference to the geometry of FIG. 6, it may be seen that this exact correction will result in interception of the target.

Typical parameters for a terminally guided bomblet in accordance with the invention are as follows:

| | |
|---|---|
| Submissile weight | 5 lbs. |
| Terminal velocity | 300 ft. per sec. |
| Drop time (1000') | 3.3 sec. |
| Scan speed | 15 revolutions per sec. |
| Scan ground speed | 60 ft. per sec. |
| Impulse required | 9 lb.-sec. |
| Sheet explosive size | 0.2 in. thick, 5 square inches. |

A smaller version of the bomblet having the same terminal velocity and rotational rate may weigh 1.25 lbs., require 2.33 lb.-second impulse provided by 1.25 square inches of 0.2 in thick sheet explosive.

Figure 7:
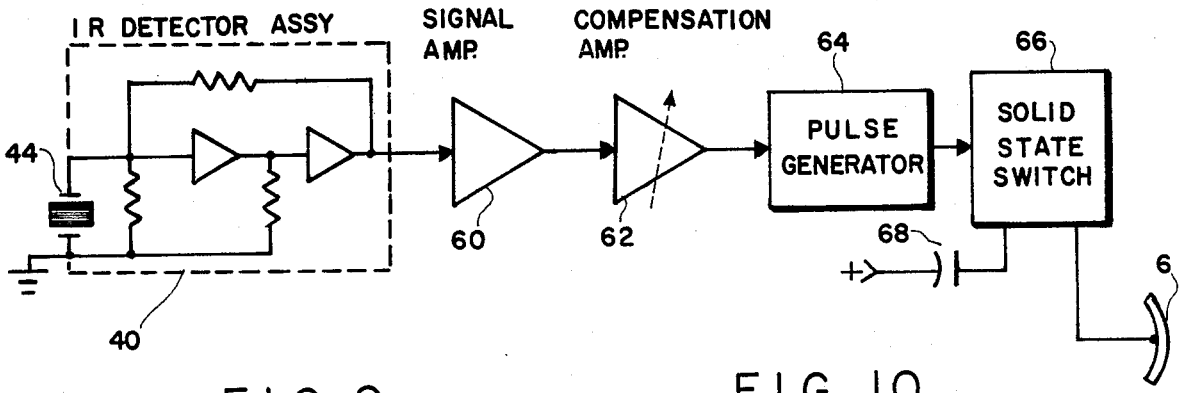
FIG. 7 is a block diagram of the IR detector and impulse charge firing system.

Next, the detection and impulse generation function of the invention that provides the firing control means will be described. Turning to FIG. 7, a block diagram of the detection electronics is shown. The IR detector 44 may be an MML 404-2 detector available from Martin Marietta Laboratories or a Model 404 Eltec Instrument Co. (Daytona Beach, Fla.) with the active element a lithium tantalate pyroelectric detector 44. The output from detector assembly 40 drives a conventional signal amplifier 60 and a compensation amplifier 62 which can be adjusted to compensate for the background infrared clutter level. The amplified detection signal is applied to pulse generator 64 which generates a trigger pulse when the signal exceeds a preselected threshold. A trigger pulse present at the output of pulse generator 64 causes solid state switch 66 to discharge firing capacitor C (68) through the Detasheet 6 initiator, detonating the Detasheet 6 thereby generating the desired impulse.

Figure 8:
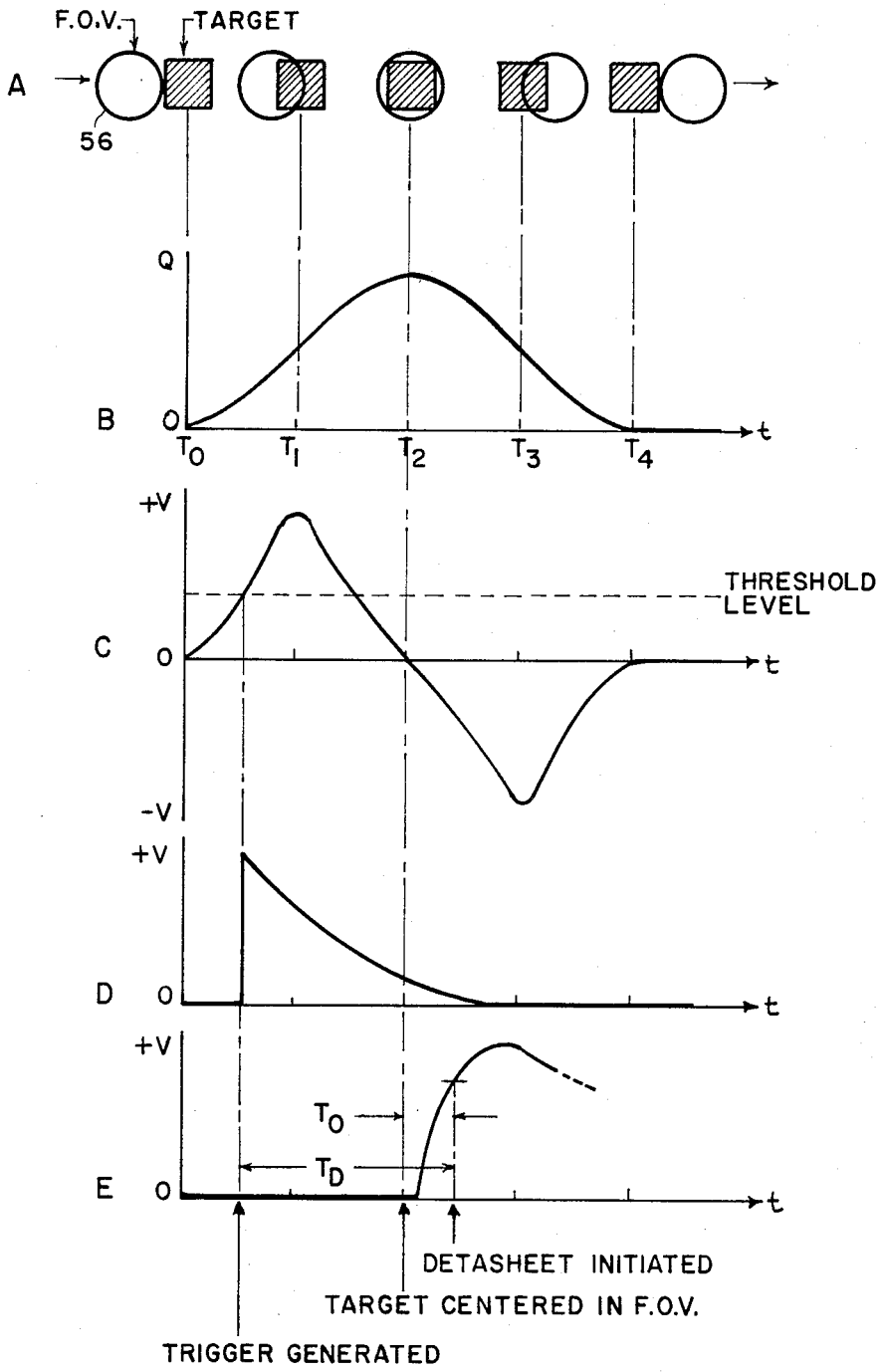
FIG. 8 is a set of typical waveforms present in the circuits of FIG. 7 as the IR detector scans across a hot target.

In accordance with the invention it is necessary that the impulse be generated such that the force vector produced be precisely aligned with the target. Therefore, the placement of the sheet explosive with reference to the scan axis of the bomblet is carefully selected with regard to the IR detector characteristics, as will be explained with reference to FIGS. 8, 9 and 10. In FIG. 8, line A, the FOV 56 is shown in sequential discrete positions as it scans past the target. The thermal input to the detector from the hot target is plotted on line B. At time $t_o$, the FOV 56 is just approaching the target and the heat Q incident on the detector is zero. At time $t_1$, the FOV 56 has partially intercepted the target, producing heat at detector 44. At time $t_2$, FOV 56 is now coincident with the target and the thermal input to detector 44 is maximum. As FOV 56 moves past the target as at $t_3$ and $t_4$, the thermal input decreases to zero. The pyroelectric detector 44 produces an output proportional to the time derivative of the thermal input as shown on line C. The amplified signal is compared to the selected threshold level, causing trigger pulse generator 64 to fire when the signal exceeds the threshold, thereby producing the trigger pulse shown in line D.

Figure 9:
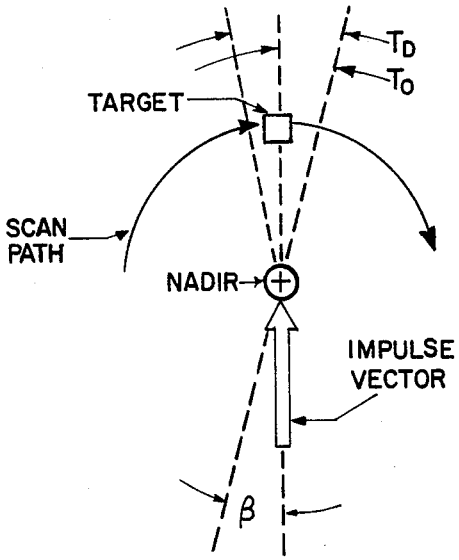
FIG. 9 is a plan view showing the angular delays involved in the target detection and impulse initiation phase.
Figure 10:
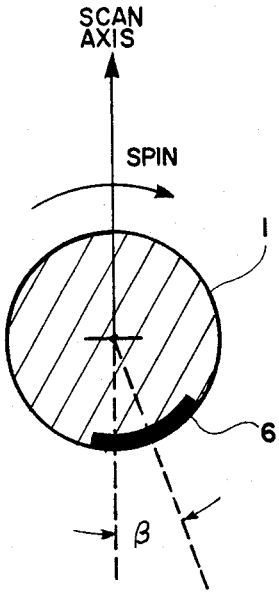
FIG. 10 is a schematic representation of a bomblet having an explosive charge installed at an offset angle with respect to the bomblet scan axis for compensating for the angular delays shown in FIG. 9.

The trigger pulse causes the firing capacitor 68 to discharge through the Detasheet 6 initiator. As illustrated in line E, the Detasheet will fire when the initiator voltage rises to the level shown. Delay $T_D$ between the trigger pulse and the firing time is due to delays in the electronic circuits and is controllable to some degree. Similarly, delay $T_O$ is the delay between the time $t_3$ that the FOV is coincident with the target and the firing time of the Detasheet. These delays are indicated in FIG. 9 in terms of the scan action of the bomblet. The impulse vector must occur precisely as shown and therefore the scan axis, defined as the radial from the vehicle center through the optical boresight offset, must lead the impulse vector by the angle $\beta$ corresponding to delay $T_O$. FIG. 10 illustrates an approach to this requirement. The required timing means may be provided by centering Detasheet 6 on a bomblet radial $\beta$ degrees ahead of the scan axis rather than directly on line with the scan axis, thus compensating for delay $T_o$.

Having described the preferred embodiment of the terminally guided submissile, certain modifications will now be explained. As previously discussed, the impulse generated by firing of the detasheet can be controlled to change the direction of travel of the bomblet so as to accurately intercept the target. It has been found that an accuracy of 3 feet from an altitude of 1000 feet can be achieved. However, under adverse weather conditions, wind and precipitation can cause the bomblet to deviate from its preset course. An advantageous modification to the preferred embodiment can be made to significantly increase the probability of an intercept.

Figure 11:
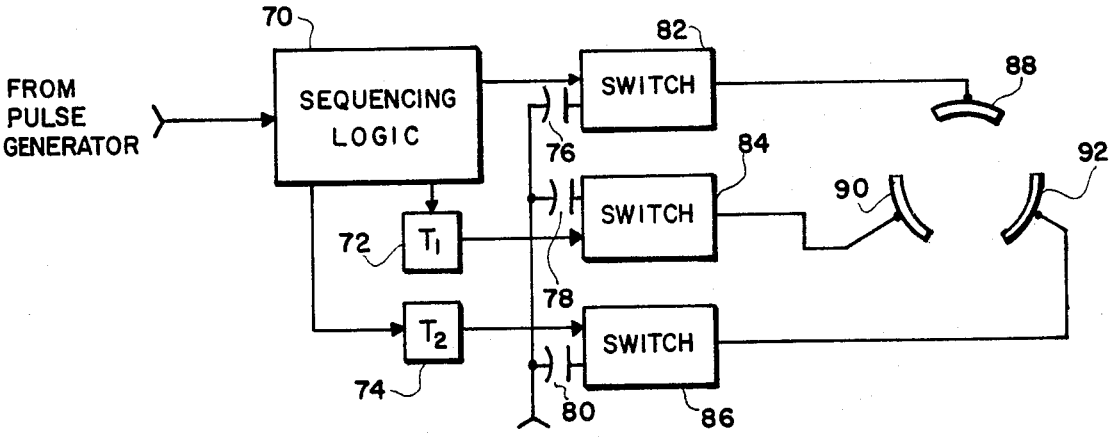
FIG. 11 is a block diagram of an alternative IR detection and impulse firing system capable of producing three successive guidance corrections.

FIG. 11 illustrates schematically the use of multiple explosive charge devices spaced around the periphery of bomblet. In this example, three sheet explosive charges 88, 90 and 92 are used. After the bomblet is dropped, the first sensing of the presence of a hot target causes a trigger pulse to be generated by the pulse generator as previously described. The output from the pulse generator drives a sequencing logic circuit 70 that causes the trigger to directly enable solid-state switch 82 which discharges first firing capacitor 76 through the initiator of first charge 88. Firing of the first charge changes the direction of bomblet 1 toward the target. The bomblet optical system continues to scan so that any deviation from the intercept path will result in a second detection of the target and a second trigger pulse from the pulse generator. Sequencing logic 70 directs the second trigger pulse to switch 84 via delay circuit 72 having a delay $T_1$. The duration of delay $T_1$ is selected to cause switch 84 to fire second explosive charge 90 at the exact time to compensate for the difference between the location of the charge and the bomblet scan axis. Similarly, if the target is detected a third time, third charge 92 is fired by switch 86 via delay circuit 74 having a delay $T_2$. Thus, the drop path of bomblet 1 can be corrected a total of three times in this embodiment, thereby ensuring a high degree of accuracy.

As may be recognized, terminally-guided bomblets may be constructed in accordance with the invention to have two and more separate Detasheet-type devices depending on desired drop altitude, accuracy required, and similar factors.

Advantageously, the electronic circuits utilized in the invention may be implemented with integrated circuits or, preferably by large scale integration (LSI) for minimum cost, space and weight considerations. Other variations in construction will be obvious to those skilled in the art. For example, versions of the bomblet have been constructed having 6 vanes for producing a very stable spin and flight attitude. Other types of IR detectors are also usable which may produce different pulse shapes to the thermal input, and therefore would require different signal processing. In another variation, the sheet explosive device utilized for one impulse can be split into more than one discrete charge as may be desirable when a multiple impulse version of the submunition is required. In such case, it is necessary to proportion and locate the split charges so that the total impulse is through the center of gravity of the vehicle and payload, and in the required direction for correcting the vehicle trajectory. In the preferred implementation, the invention has been shown applied to droppable submunitions. It will be obvious to those skilled in the art that the invention may be applied to any small munition such as a mortar shell and an artillery shell which may be launched toward hot targets and advantageously utilize terminal trajectory correction. Such variations in design and construction are to be considered within the spirit and scope of this invention.

Although I am not to be limited to any particular warhead 30, most of the experimentation involved in the reduction to practice of this invention involved the use of Octol Composition B, with the attenuating material 4 of polyurethane foam being successful in preventing detonation of the warhead at such time as the detasheet explosive is set off in accordance with this invention. The fuse 26 can be any of several conventional fuses used in current munitions, and for example may be an M 223 fuse used either with or without a booster.

I claim:

1. A bomblet having a correctible terminal trajectory and being capable of being air-dropped in a cluster together with a multiplicity of said bomblets comprising:

a body having a nose portion and a tail portion, said body carrying a warhead, a plurality of vanes hingedly attached to said tail portion of said body, said vanes being maintained in a closed position prior to being airdropped such that said vanes are disposed longitudinally along the outer surface of said body, said vanes being arranged to change to an open position when airdropped, thereupon said vanes being caused to extend rearwardly from said tail portion, said vanes being continuously maintained in a canted attitude with respect to the longitudinal centerline of said body so as to cause said body to spin from airflow caused by dropping of said body, heat detection means disposed in said nose portion of said body, said heat detection means having a narrow forward field-of-view, said field-of-view having a boresight line slightly displaced from the fore and aft axis of said body, thereby producing a rotating scan axis as a result of the rotation of said body, said field-of-view occuring at body spin rate in an inward spiral pattern on the ground as said bomblet approaches the ground, said heat detection means producing a detection signal when said field-of-view scans across a target having a higher temperature than the ground, firing pulse generation means disposed in said body and connected to said heat detection means for receiving such detection signal for generating an electrical firing pulse in response thereto, and an explosive charge disposed on the outer surface of said body, said charge being connected to said firing pulse means and arranged to fire in response to such electrical firing pulse, said explosive charge producing a lateral impulse in a direction substantially perpendicular to said body upon such firing, to change the terminal trajectory of said bomblet in the direction of the target causing such detection signal.

2. A bomblet having a correctible terminal trajectory and being capable of being airdropped in a cluster together with a multiplicity of said bomblets comprising:

a body having a nose portion and a tail portion, said body carrying a warhead, a plurality of vanes hingedly attached to said tail portion of said body, said vanes being maintained in a closed position prior to being airdropped such that said vanes are disposed longitudinally along the outer surface of said body, said vanes being arranged to change to an open position when airdropped, thereupon said vanes being maintained to extend rearwardly from said tail portion, said vanes being canted so as to cause said body to rotate from airflow caused by dropping of said body, heat detection means disposed in said nose portion of said body, said heat detection means having a narrow forward field-of-view, said field-of-view having a boresight line slightly displaced from the fore and aft axis of said body, thereby producing a rotating scan axis as a result of the rotation of said body, said field-of-view occuring in an inward spiral pattern on the ground as said bomblet approaches the ground, said heat detection means producing a detection signal when said field-of-view scans across a target having a higher temperature than the ground, firing pulse generation means disposed in said body and connected to said heat detection means for receiving such detection signal and for generating an electrical firing pulse in response thereto, and an explosive charge disposed on the outer surface of said body, said charge being connected to said firing pulse means and arranged to fire in response to such electrical firing pulse, said explosive charge producing a lateral impulse on said body upon such firing to change the terminal trajectory of said bomblet in the direction of target causing such detection signal, said heat detection means being maintained in a retracted position within said nose portion by said vanes when in the closed position prior to being airdropped, said heat detection means extending to an operative position when said bomblet is airdropped.

3. The bomblet as defined in claim 2 in which said heat detection means includes a pyroelectric detector responsive to infrared radiations and an essentially parabolic mirror, said pyroelectric detector disposed at the focal point of said mirror thereby producing said narrow field-of-view, and said mirror is positioned so as to displace its boresight line at a selected angle with respect to said fore and aft axis of said body.

4. The bomblet as defined in claim 3 in which said warhead is a shaped explosive charge disposed in a fragmenting case, shaping of said charge being provided by a Misznay-Schardin disc disposed at the forward end of said case, and said essentially parabolic mirror is formed by providing a reflective surface on the forward face of said Misznay-Schardin disc.

5. The bomblet as defined in claim 4 further comprising:

a plurality of said explosive charges disposed on said outer surface of said body; and firing pulse sequencing means connected to said firing pulse generation means and to each of said plurality of explosive charges, said sequencing means arranged to fire said explosive charges in sequences as such detection signals are produced by said heat detection means.

6. The bomblet as defined in claim 3 further comprising energy attenuation means disposed on said outer surface of said body for partially dissipating energy produced by firing of said explosive charge.

7. A bomblet having a correctable terminal trajectory comprising:

a body having a nose porion and tail portion, and carrying a warhead, a plurality of vanes attached to the tail portion of said body and being configured to cause said body to spin during its fall through the atmosphere, detection means disposed in the nose portion of said body, said detection means being in an active mode during airdrop, and scanning at body spin rate in an inward spiral pattern on the ground as said body approaches the ground, said detection means having means for producing a detection signal when its field-of-view scans across a target having a unique signature, firing pulse generation means disposed in said body and connected to said detection means for receiving such detection signals and for generating an electrical firing pulse in response thereto, and impulsive control means disposed on said body, said control means being connected to said firing pulse means and arranged to respond to such electrical firing pulse, said control means producing at least one lateral impulse substantially perpendicular to the centerline of said body upon such firing and thereby serving to change the terminal trajectory of said bomblet in the direction of the target causing such detection signal.

8. A bomblet having a correctable terminal trajectory comprising:

an aerodynamic body having a sensor, a warhead, an impulse control, and a fin assembly, said fin assembly causing said body to spin during its descent through the atmosphere, said sensor having a field-of-view angled to be offset from the body centerline and being mounted to sweep the ground at body spin rate in a spiral path of ever decreasing size as said body descends, said sensor being designed to detect the presence of a unique feature of a ground target, said impulse control being supported by said body and placed to bring about the application of at least one lateral impulse to the body at such time as the unique feature of the target is detected, such lateral impulse serving to correct the trajectory of the body such that it closely approaches the target having the unique feature.

* * * * *